US010342276B2

(12) United States Patent
Buri

(10) Patent No.: US 10,342,276 B2
(45) Date of Patent: Jul. 9, 2019

(54) HEADWEAR WITH DEPLOYABLE PROTECTIVE MATERIAL

(71) Applicant: JKB Ventures, LLC, Parkville, MO (US)

(72) Inventor: James Joseph Buri, Parkville, MO (US)

(73) Assignee: JKB Ventures, LLC, Parkville, MO (US)

( * ) Notice: Subject to any disclaimer, the term of this patent is extended or adjusted under 35 U.S.C. 154(b) by 233 days.

(21) Appl. No.: 15/175,830

(22) Filed: Jun. 7, 2016

(65) Prior Publication Data

US 2016/0353823 A1 Dec. 8, 2016

Related U.S. Application Data

(60) Provisional application No. 62/172,585, filed on Jun. 8, 2015.

(51) Int. Cl.

| | |
|---|---|
| ***A42B 1/00*** | (2006.01) |
| ***A42B 1/06*** | (2006.01) |
| *A42B 1/22* | (2006.01) |

(52) U.S. Cl.
CPC ..... *A42B 1/067* (2013.01); *A42B 1/068* (2013.01); *A42B 1/225* (2013.01)

(58) Field of Classification Search
CPC ..... A42B 1/067; A42B 1/068; A42B 1/225
See application file for complete search history.

(56) References Cited

U.S. PATENT DOCUMENTS

| | | | | |
|---|---|---|---|---|
| 2,462,258 A * | 2/1949 | Dannenberg | A42B 1/062 2/10 |
| 2,839,757 A | 6/1958 | Gianola | |
| 3,055,012 A * | 9/1962 | Aileo | A42B 3/105 2/205 |
| 4,486,903 A * | 12/1984 | Krystal | A42B 1/068 2/172 |
| 4,593,417 A | 6/1986 | Brown, Jr. et al. | |
| 4,845,782 A * | 7/1989 | Gregg | A42B 1/066 2/172 |
| 4,951,319 A | 8/1990 | Phillips, Jr. et al. | |
| 5,119,514 A | 6/1992 | Woehl | |
| 5,323,491 A | 6/1994 | Barrett, Jr. | |

(Continued)

*Primary Examiner* — Khaled Annis
(74) *Attorney, Agent, or Firm* — Law Office of Mark Brown, LLC; Ryan S. Hinderliter

(57) ABSTRACT

Headwear comprising a common baseball cap with an additional section of material permanently attached to the rear of the baseball cap. In a preferred embodiment, the section of material may either be tucked into and concealed under the baseball cap or selectively deployed over the head, ears, and neck of the wearer. The deployable protective material includes an elastic outer edge to ensure a secure fit around the wearer's head, ears, and neck. The securely fitted material provides protection to the wearer's head, ears, and neck from uncomfortably cool, hot, and/or wet climatic conditions and from uncomfortable, unfavorable, or otherwise personally damaging surrounding conditions to which the wearer may be exposed. Additionally, the sewing method for attaching the selectively deployable material to the baseball cap provides a comfortable fit and feel to the wearer whether the material is concealed under the cap or deployed from the rear of the cap.

16 Claims, 10 Drawing Sheets

(56) References Cited

U.S. PATENT DOCUMENTS 5,355,535 A * 10/1994 Bruder ..... A42B 1/067 2/172
5,400,440 A 3/1995 Clifford
5,426,790 A 6/1995 Robertson
5,603,120 A * 2/1997 Gifford ..... A42B 3/105 2/172
5,623,732 A * 4/1997 Olajide, Jr. ..... A42B 1/064 2/172
5,644,799 A * 7/1997 Armenta ..... A42B 1/225 132/273
5,884,334 A * 3/1999 Collette ..... A42B 1/065 2/10
5,933,872 A * 8/1999 Lema ..... A42B 1/225 2/209.3
6,163,886 A 12/2000 Carter
6,233,745 B1 * 5/2001 Friesen ..... A42B 1/008 2/171.2
6,966,072 B1 * 11/2005 Kobayashi ..... A42B 1/008 2/209.13
7,134,147 B2 11/2006 Yount
2001/0016958 A1 7/2001 Linday
2004/0139530 A1 * 7/2004 Yan ..... A42B 1/067 2/209.13
2004/0244095 A1 * 12/2004 Sonne ..... A42B 1/067 2/175.4
2007/0192934 A1 * 8/2007 Niedrich ..... A42B 1/004 2/171
2008/0052804 A1 3/2008 Woodward
2008/0163405 A1 7/2008 Jacquart et al.
2009/0199323 A1 * 8/2009 Zakarian ..... A42B 1/225 2/209.14
2009/0255030 A1 * 10/2009 Guy ..... A42B 1/225 2/84
2011/0055997 A1 3/2011 Tyler
2012/0047628 A1 3/2012 Hardy
2012/0159695 A1 6/2012 Hardy
2016/0128411 A1 * 5/2016 Ayres ..... A42B 1/241 2/172
2016/0309872 A1 * 10/2016 Domizi ..... A45D 19/18

* cited by examiner

HEADWEAR WITH DEPLOYABLE PROTECTIVE MATERIAL

CROSS-REFERENCE TO RELATED APPLICATION

This application claims priority in U.S. Provisional Patent Application Ser. No. 62/172,585, filed Jun. 8, 2015, which is incorporated herein by reference.

BACKGROUND OF THE INVENTION

1. Field of the Invention

The present invention relates generally to headwear, more specifically headwear that may, at the wearer's option, appear, fit, and feel like a common baseball cap, or serve to protect the wearer's head, ears, and neck from uncomfortable, unfavorable, or otherwise personally damaging surrounding conditions which the wearer may be exposed to, regardless of whether the wearer is outdoors or in a climate controlled space.

2. Description of the Related Art

Baseball caps, or baseball hats, generally consist of a bill or visor; a crown; and a reinforced or "double thickness" material (a band or sweatband) which extends around the bottom circumference of the cap's crown, providing the wearer with a secure, yet comfortable fit. The crown of a baseball cap is typically made up of multiple sewn together material gores, but alternatively, the crown can be made up of one piece of material. This application acknowledges baseball caps as prior art.

Additionally, the prior art includes several caps and attachments for baseball caps which drape over a wearer's head, ears, and/or neck. However, the prior art does not disclose a baseball cap with the advantages of the present invention. The advantages include the option of wearing the present invention in a manner appearing as a common baseball cap or deploying a protective material which securely fits over and protects the wearer's head, ears, and neck.

SUMMARY OF THE INVENTION

The invention disclosed herein comprises a common baseball cap with an additional section of material permanently attached to the rear of the baseball cap. In a preferred embodiment, the section of material may either be tucked up into and concealed under the baseball cap or selectively deployed over the head, ears, and neck of the wearer. The present invention makes significant improvements upon a common baseball cap by offering the wearer the option to selectively transform the baseball cap by deploying the section of material from the rear of the baseball cap and securely fitting the section of material over the wearer's head, ears, and neck.

The selectively deployable material is configured to include an elastic edge, which provides the secure fit over the wearer's head, ears, and neck. The elastic edge is accomplished either because of stretchy properties of the material itself or via the attachment of an elasticized band to the edge of the material. Optionally, tufts may be sewn into the selectively deployable material to gather the material in a manner to ensure that the section of material would not "blouse away" from the wearer's head, providing a further secured fit. The securely fitted material provides protection to the wearer's head, ears, and neck from uncomfortably cool, hot, and/or wet climatic conditions and from uncomfortable, unfavorable, or otherwise personally damaging surrounding conditions to which the wearer may be exposed. The present invention is configured to protect the wearer from surrounding conditions regardless of whether the wearer is outdoors or in a climate controlled space. Additionally, the sewing method for attaching the selectively deployable material to the baseball cap provides a comfortable fit and feel to the wearer whether the section of material is concealed under the baseball cap or deployed from the rear of the baseball cap.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
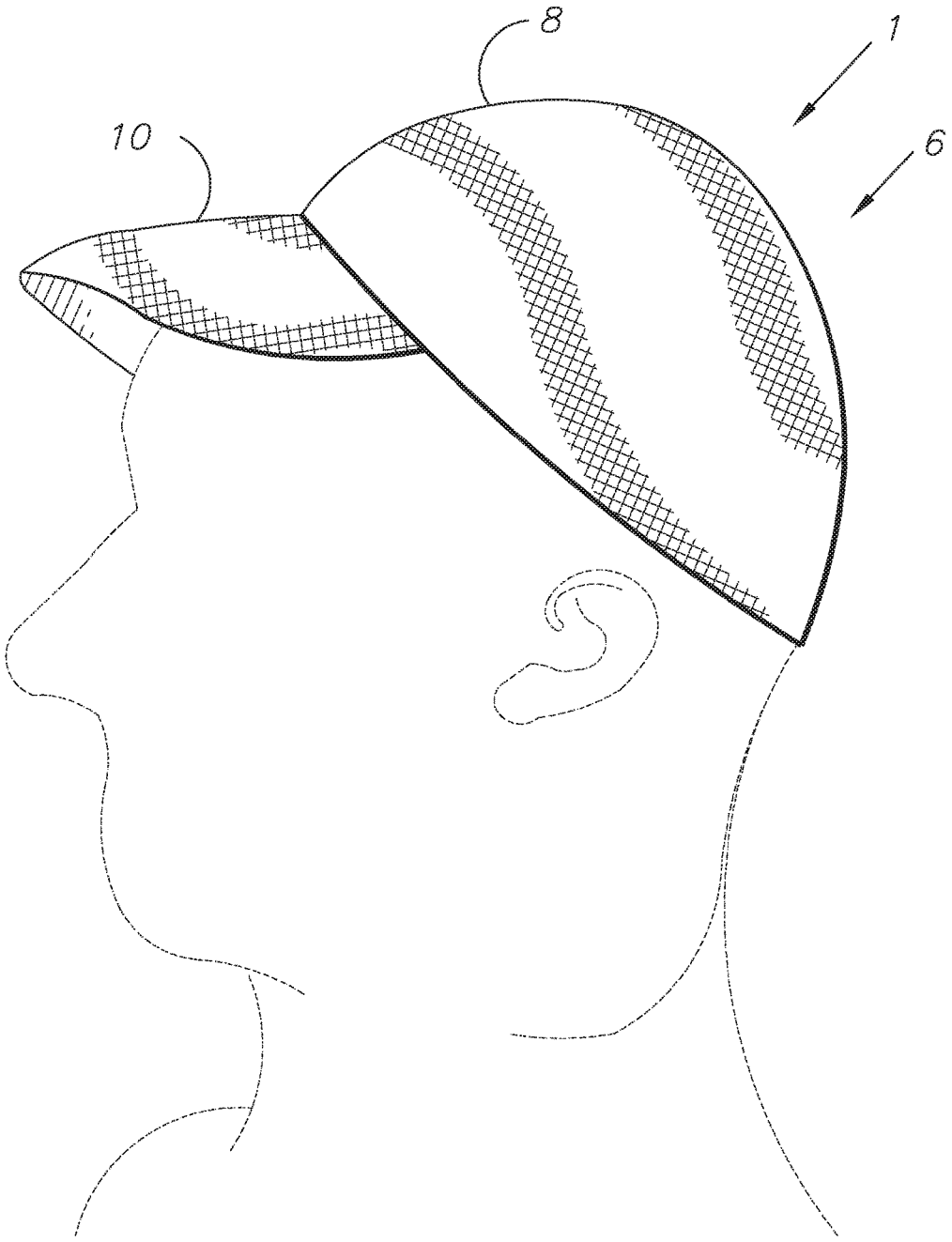
FIG. 1 is a side view of a baseball cap with selectively deployable material tucked inside the baseball cap embodying the present invention.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiments

The disclosed invention comprises headwear including a common baseball cap plus a section of material permanently attached to the rear of the baseball cap which may be selectively deployed from the rear of the baseball cap. The headwear may be worn in the form of a common baseball cap, with the selectively deployable material tucked within the crown of the baseball cap, or with the material deployed from the rear of the baseball cap and securely fitted around the wearer's head, ears, and neck. When deployed, the section of material provides the wearer with protection from uncomfortable, unfavorable, or personally damaging surrounding conditions to which the wearer may be exposed. Such damaging surrounding conditions could be outdoors or in a climate controlled space. Most typically, the selectively deployable material is used to protect the wearer from uncomfortably cool, hot, and/or wet climatic conditions. However, a wearer may selectively deploy the material to protect from exposure to other uncomfortable, unfavorable, or personally damaging conditions, such as direct sunlight, high wind velocity, windblown sand, other windblown particles, or any other surrounding condition. The headwear of the present invention could also be used as an alternative to a hairnet for food-related services.

When deployed, the attached protective material is also configured to decrease the loss of body heat from the wearer's head, ears, and neck due to convection. The deployable material shields or protects the wearer's head, ears, and neck from air movement generated either from external sources or from the wearer's movement. Additionally, the deployable material decreases the loss of body heat from the wearer's head, ears, and neck due to radiation, conduction, and/or evaporation of sweat. When the selectively deployable material is tucked into the crown of the baseball cap, the present invention provides an additional layer of protection from heat loss through the top of the wearer's head.

The method of attaching the section of protective material to the rear of the crown portion of the baseball cap ensures a comfortable fit both when the material is deployed outside the baseball cap and when the material is folded up into the crown of the cap. The edge of the selectively deployable material to be sewn onto a rim of the rear portion of the baseball cap is cut significantly longer than the circumference of the rear portion of the baseball cap. To bring the length of this edge of the deployable material into conformance, an elastic edge is cut to match the circumference of the rear portion of the baseball cap where the deployable material will be attached. The elastic banding is then stretched to match the longer length of the selectively deployable material. The elastic edge, while stretched, is sewn onto the edge of the deployable material. Once sewn to the deployable material, the elastic edge is allowed to return to its original, non-stretched length, which exactly matches the circumference of the rear portion of the baseball cap. The deployable material is, thereby, reduced to the proper length and is uniformly gathered, ensuring a comfortable fit whether the deployable material is concealed or deployed by the wearer. Additionally, an elastic edge may or may not be sewn onto the outer edge of the deployable material to ensure a secure fit over the wearer's head, ears, and neck.

Referring to the drawings in more detail, the reference numeral 1 generally designates a cap including a selectively deployable section of protective material 2. The cap 1 includes a crown portion 8 and a bill or visor 10, like a common baseball cap. The crown 8 may be comprised of multiple sewn together material gores or one material piece. The bill 10 is connected to the front of the crown portion 8 of the cap 1 and designed for shielding sunlight from the wearer's face. The crown portion of the cap optionally may be fitted to a particular cap size, may include stretching or "flex-fit" properties allowing the cap to fit several head sizes, or may be adjustable. The embodiments shown in FIGS. 1-5 show caps having fitted or stretchable crowns. The embodiments shown in FIGS. 6-10 show caps having adjustable crowns. Adjustable straps may include Velcro-type hook and loop fasteners, snapping mechanisms, buckle mechanisms, or any alternative type of headwear adjustment mechanism.

FIG. 1 shows a side or profile view of a cap 1 in a first configuration 6 with selectively deployable protective material 2 tucked up inside the crown 8 of the baseball cap 1. Wearing the cap 1 in such a manner gives the external appearance that the wearer is wearing a common baseball cap having only a crown 8 and a bill 10 with no obvious modifications thereto.

Figure 2:
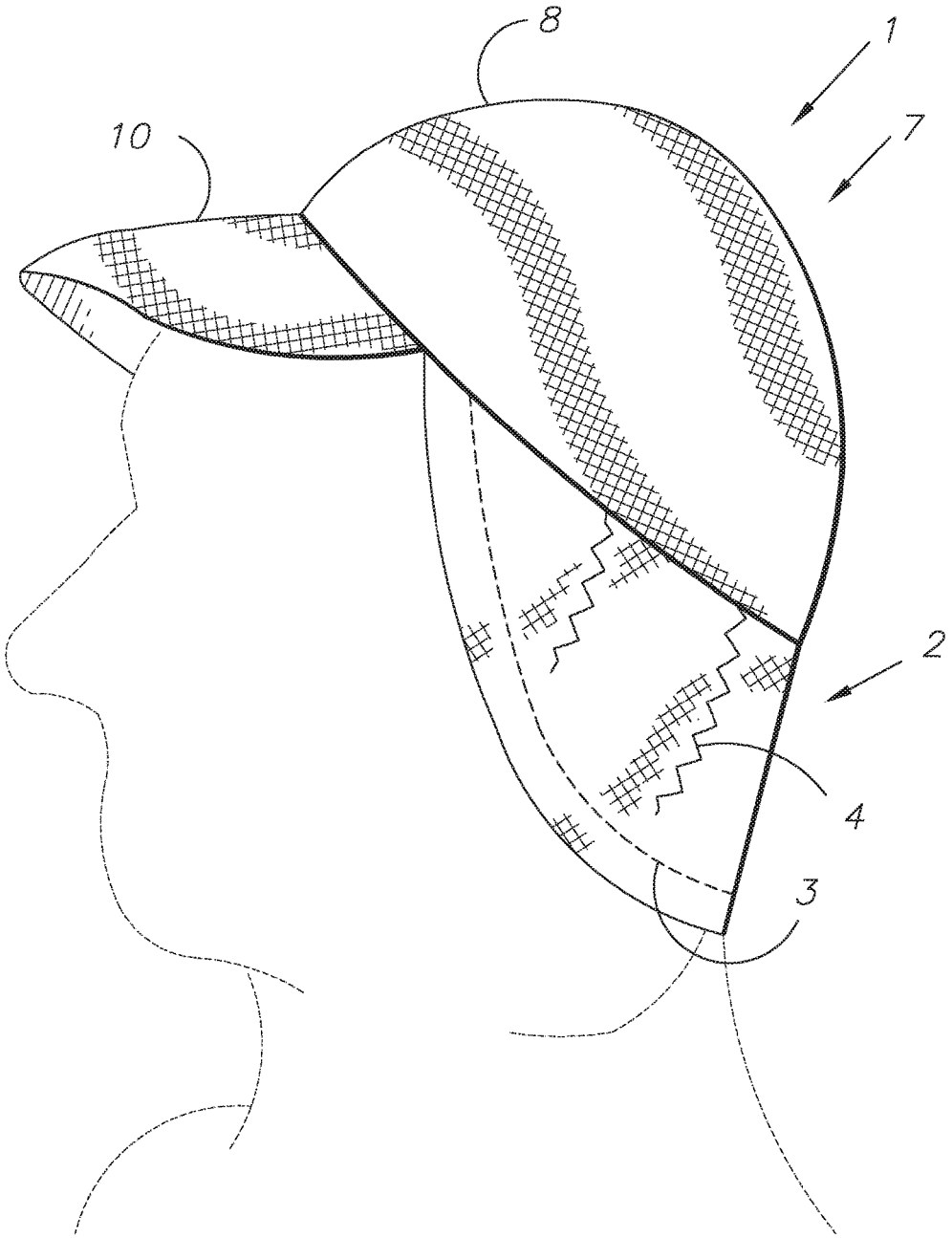
FIG. 2 is a side view of the baseball cap with the selectively deployable material deployed outside the cap and over the wearer's head, ears, and neck.

FIG. 2 shows a side or profile view of the cap 1 being worn in a second configuration 7 with the section of protective material 2 selectively deployed from the rear portion of the crown 8 of the baseball cap over the wearer's head, ears, and neck. The protective material 2 includes an elastic outer edge 3 which provides a secure fit around the wearer's head, ears, and neck. The selectively deployable material 2 also includes an elastic inside edge which is attached to the rim of the crown 8 of the cap 1 and provides for a secure and comfortable fit both when the material 2 is deployed and tucked inside the crown 8. The elastic edges are accomplished either by inherent stretching properties within the material 2 or an attached elasticized band. In embodiments having an elasticized band, the band is attached to the underside of the section of material (between the material and the wearer). In a preferred embodiment, the selectively deployable protective material 2 is composed of a "dri-fit" material made of microfiber, polyester fabric commonly found in men's elasticized sports underwear or boxer shorts. Alternatively, the protective material 2 can be made up of other polyester blends, cotton, cotton blends, spandex, combinations thereof, or any other fabric material. The cap 1 may optionally include tufts 4 sewn into the selectively deployable material 2, as shown in FIG. 2. The tufts 4 allow the protective material 2 to be gathered in a manner to ensure that the material would not "blouse away" from the wearer's head. If the deployable material 2 has stretchy properties, tufts 4 may not be required to ensure a proper, secure fit around the wearer's head, ears, and neck.

Figure 3:
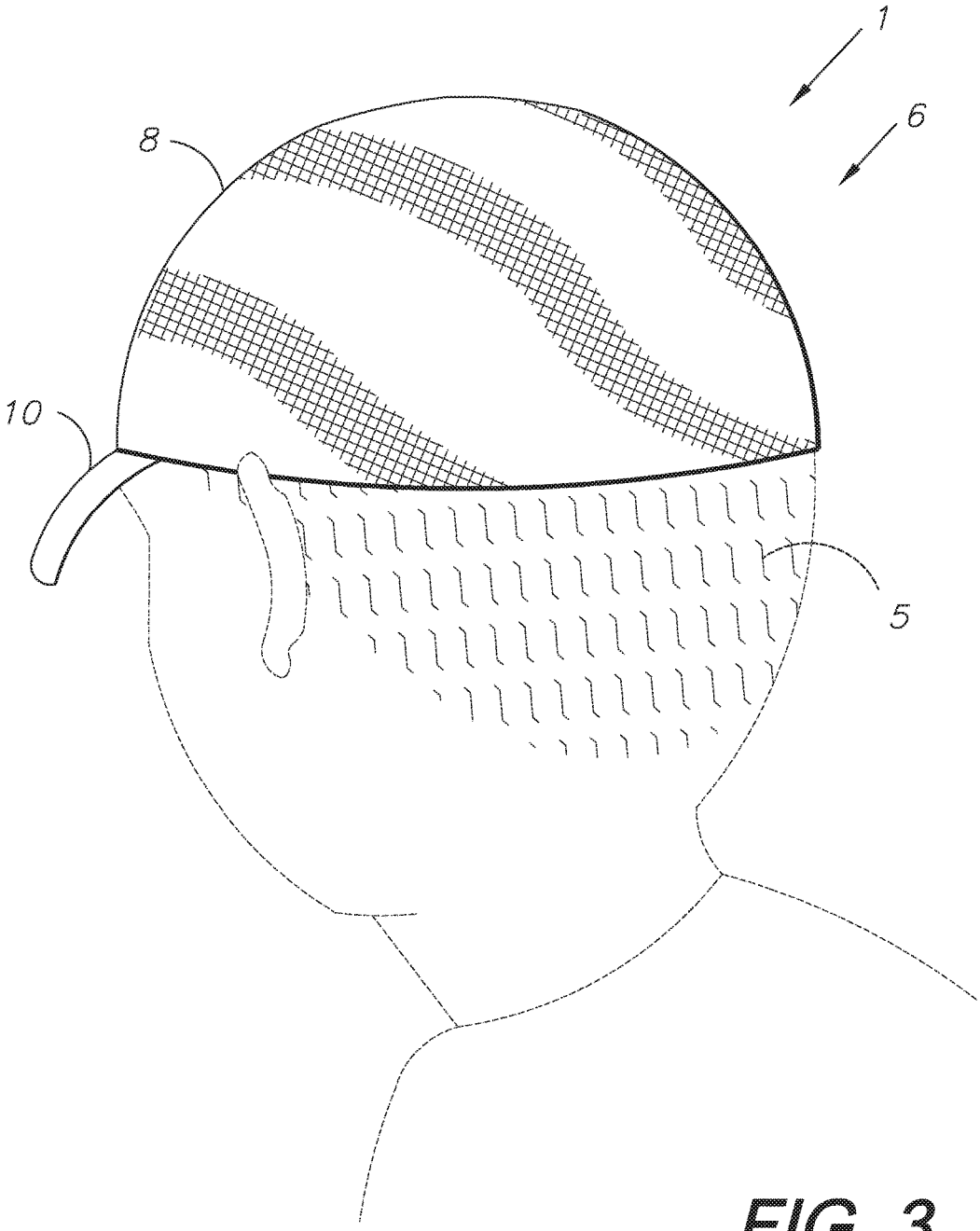
FIG. 3 is a rear, perspective view of the baseball cap with the selectively deployable material tucked inside the cap.

FIG. 3 shows a rear, perspective view of the cap 1 in the first configuration 6 worn with the selectively deployable material 2 tucked up inside and concealed under the crown 8 of the cap 1. The wearer's hair 5, in FIG. 3, is clearly visible, presenting the external appearance of a common baseball cap with only a crown portion 8 and a bill 10 and no obvious modifications thereto.

Figure 4:
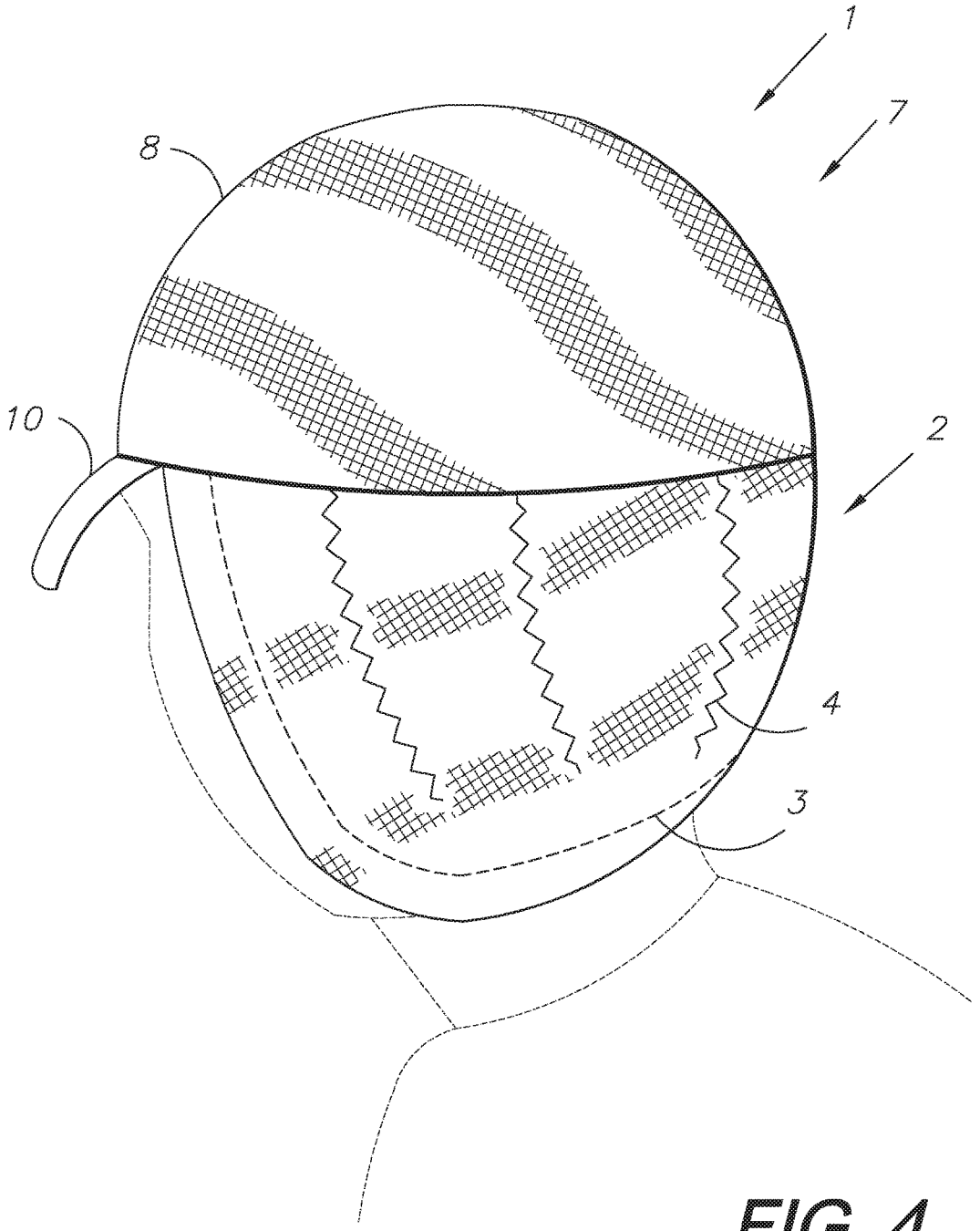
FIG. 4 shows a rear, perspective view of the baseball cap with the selectively deployable material deployed outside the cap and over the wearer's head, ears, and neck.

FIG. 4 shows a rear, perspective view of the cap 1 in the second configuration 7 with the section of protective material 2 selectively deployed from the rear portion of the crown 8 of the baseball cap 1 over the wearer's head, ears, and neck. FIG. 4 illustrates the elastic end 3 and tufts 4 of the protective material 2 providing a secure fit over the wearer's head, ears, and neck.

Figure 5:
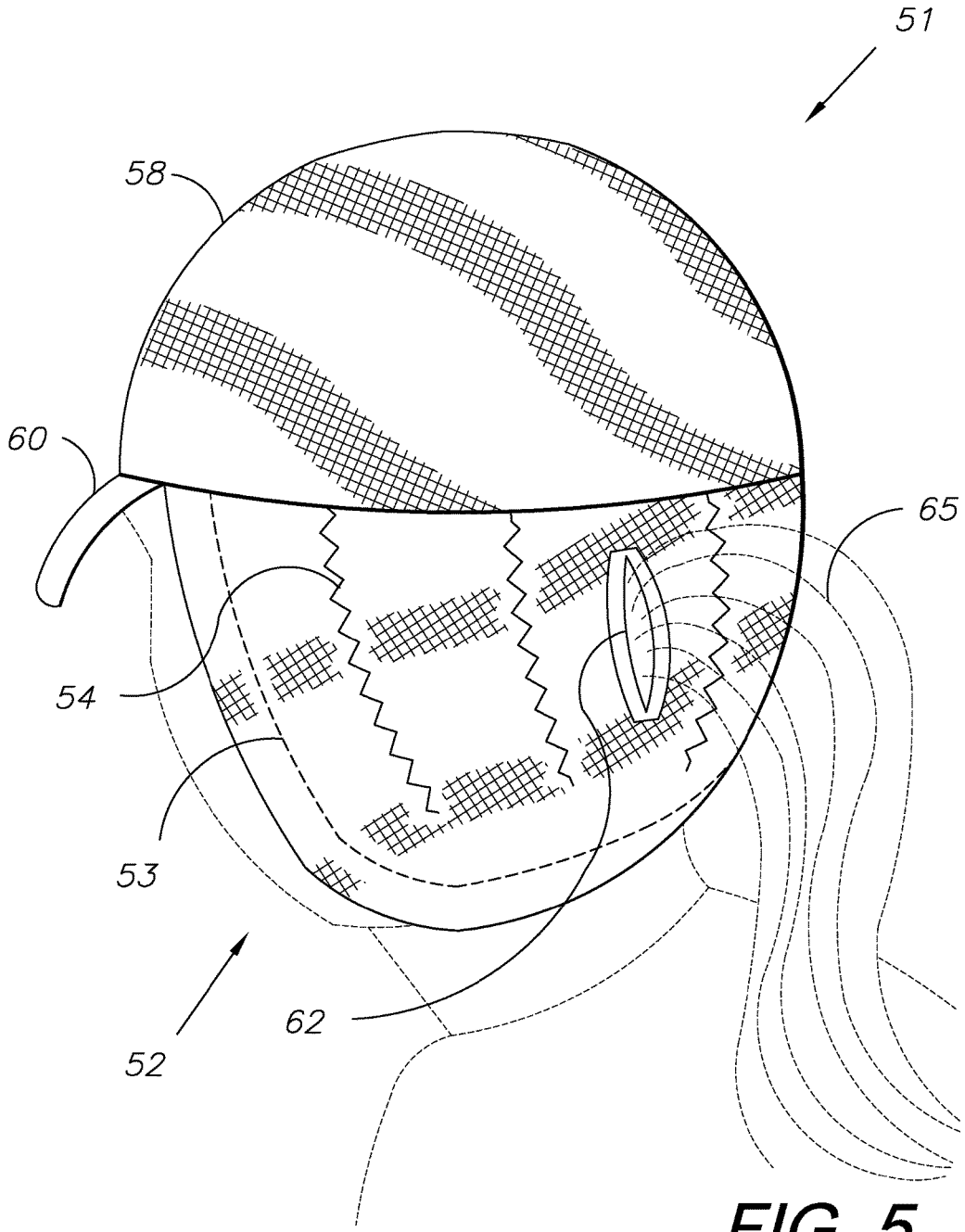
FIG. 5 shows a rear, perspective view of an alternative embodiment of a baseball cap embodying the present invention with protective material worn outside the cap.

FIG. 5 shows an alternative embodiment of a cap 51 including a common baseball cap portion with a crown 58 and a bill or visor 60 along with a section of selectively deployable protective material 52. This embodiment is intended to allow use by a wearer with long hair 65. Long hair is intended to mean elongated hair extensions extending from the back of the wearer's head. Elongated hair extensions may include, but are not limited to, natural hair, artificial hair extensions, ponytails, braids, and mullets. FIG. 5 shows the protective material 52 selectively deployed over the wearer's head, ears, and neck. The section of protective material 52 includes a hair opening 62, which allows the wearer's hair 65 to be pulled through. The embodiment shown in FIG. 5 includes an elastic edge 53 and sewn-in tufts 54, allowing for secure fit around the wearer's head, ears, and neck, with the hair opening 62 allowing hair 65 to be pulled through.

Figure 6:
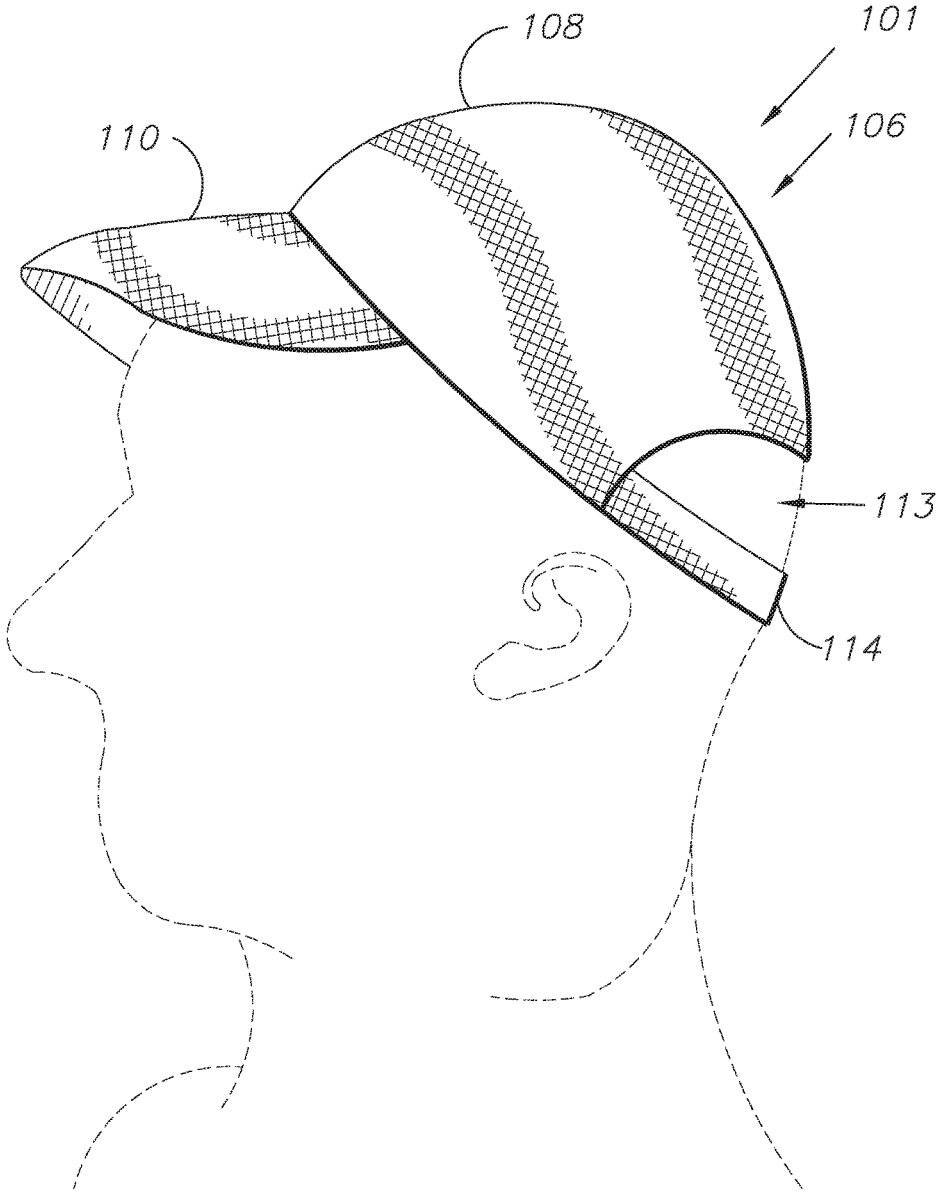
FIG. 6 is a side view of another embodiment of a baseball cap with selectively deployable material tucked inside the baseball cap embodying the present invention.

FIG. 6 shows a side or profile view of another embodiment of a cap 101 embodying the present invention in a first configuration 106 with protective material 102 tucked up inside the crown 108 of the cap 101. The crown 108 of the cap 101, in this embodiment, includes an adjustable strap 114 for adjusting the size of the crown 108. The protective material 102 folds up inside the crown 108 without covering the opening 113 formed above where the adjustable strap 114 meets the crown 108. This provides an external appearance of a common baseball cap having simply a crown portion 108 and a bill or visor 110 with no obvious modifications thereto.

Figure 7:
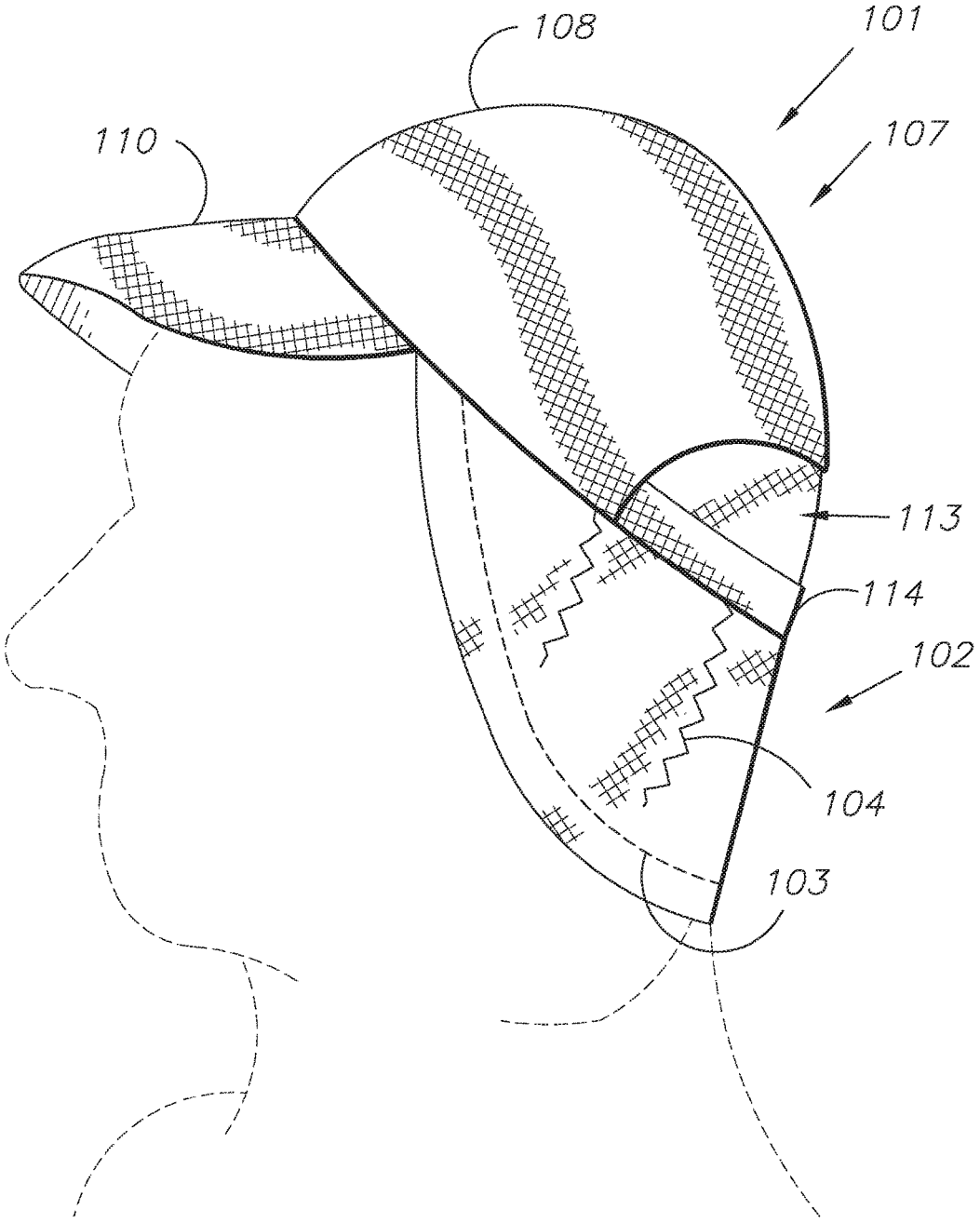
FIG. 7 shows a side view of the baseball cap with the selectively deployable material deployed outside the cap and over the wearer's head, ears, and neck.

FIG. 7 shows a side or profile view of the cap 101 being worn in a second configuration 107 with the section of protective material 102 selectively deployed from the rear portion of the crown 108 of the cap 101 over the wearer's head, ears, and neck. The deployed protective material 102 lies underneath the adjustable strap 114, illustrating attachment of the selectively deployable material 102 to the crown 108 above the opening 113 so that the opening 113 is covered in the second configuration 107 with the selectively deployable material 102 deployed. The embodiment shown in FIG. 7 includes an elastic edge 103 and sewn-in tufts 104, providing a secure fit around the wearer's head, ears, and neck. The tufts 104 gather the protective material 102 in a manner to ensure that the material would not "blouse away" from the wearer's head. However, if the deployable material 102 has stretchy properties, tufts may not be required to ensure a proper, secure fit.

Figure 8:
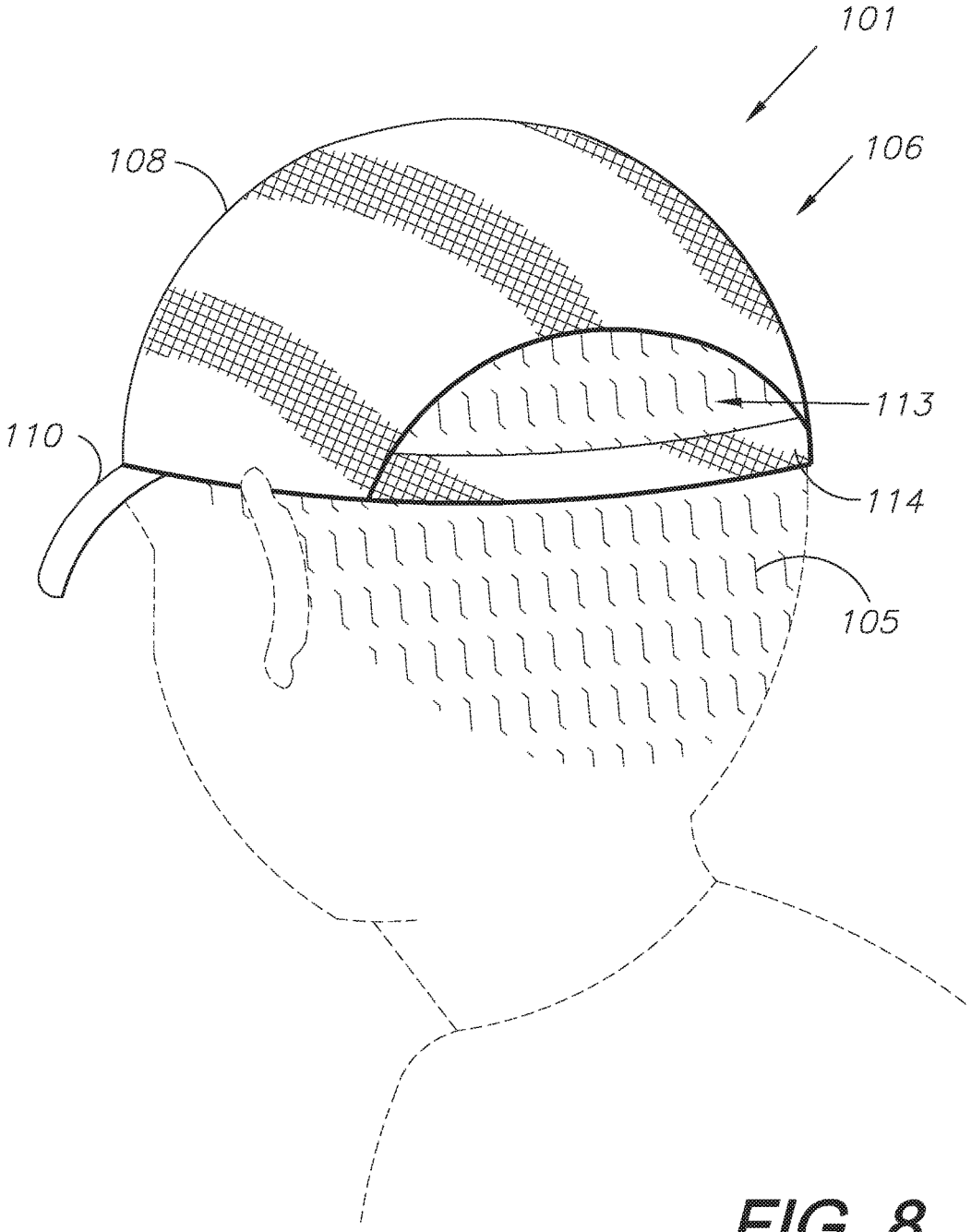
FIG. 8 is a rear, perspective view of the baseball cap with the selectively deployable material tucked inside the cap.

FIG. 8 shows a rear, perspective view of the cap 101 worn in the first configuration 106 with the selectively deployable material 102 tucked up inside and concealed under the crown 108 of the cap 101. The wearer's hair 105, in FIG. 8, is clearly visible through the opening 113 above the adjustable strap 114, presenting the external appearance of a common baseball cap having a bill 110 and a crown portion 108 with an adjustable strap 114 and no obvious modifications thereto.

Figure 9:
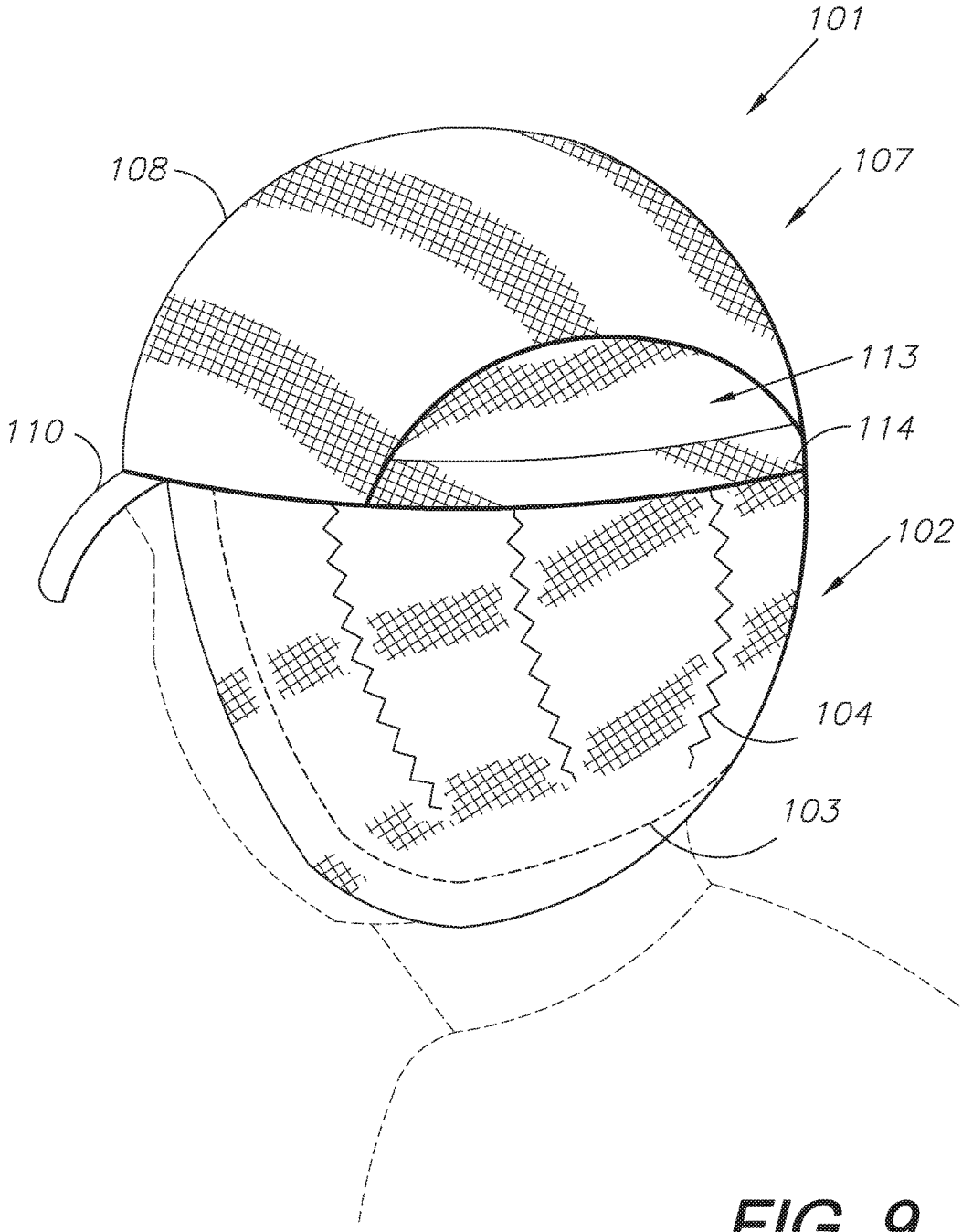
FIG. 9 is a rear, perspective view of the baseball cap with the selectively deployable material deployed outside the cap and over the wearer's head, ears, and neck.

FIG. 9 shows a rear, perspective view of the cap 101 in the second configuration 107 with the section of protective material 102 selectively deployed from the rear portion of the crown 108 of the baseball cap 101 over the wearer's head, ears, and neck. The deployed protective material 102 lies underneath the adjustable strap 114, illustrating attachment of the selectively deployable material 102 to the crown 108 above the opening 113 so that the opening 113 is covered in the second configuration 107 with the selectively deployable material 102 deployed. FIG. 9 illustrates the elastic edge 103 and tufts 104 of the protective material 102 providing a secure fit over the wearer's head, ears, and neck.

Figure 10:
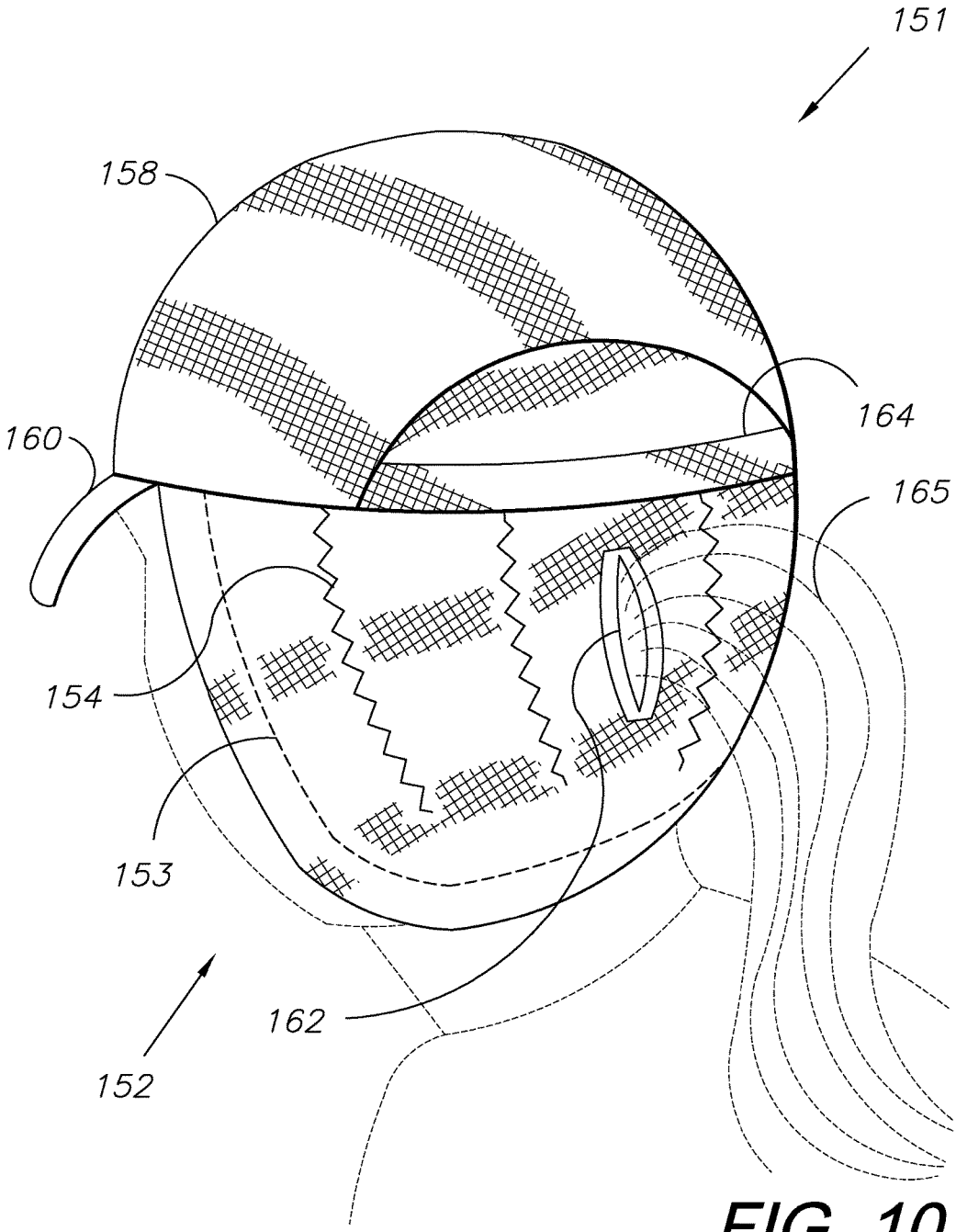
FIG. 10 shows a rear, perspective view of an alternative embodiment of a baseball cap embodying the present invention with protective material worn outside the cap.

FIG. 10 shows an alternate embodiment of a cap 151 including a common baseball cap portion having a bill 160 and a crown 158 with an adjustable strap 164 along with a section of selectively deployable protective material 152. This embodiment is intended to allow use by a wearer with long hair 165. FIG. 10 shows the protective material 152 selectively deployed lying underneath the adjustable strap 164 and over the wearer's head, ears, and neck. The section of protective material 152 includes a hair opening 162, which allows the wearer's hair to be pulled through. The embodiment shown in FIG. 10 includes an elastic edge 153 and sewn-in tufts 154, allowing for secure fit around the wearer's head, ears, and neck, with the hair opening 162 allowing hair 165 to be pulled through.

The headwear embodying the present invention may or may not include accessories, appurtenances, or items affecting the baseball cap's appearance, including but not limited to vent holes; sweat bands; crowns of varying shapes and sizes; bills of varying shapes and sizes; and adornments or additions of varying shapes, sizes, and colors. Embodiments may or may not include, as part of the ornamental design of the baseball cap, names, logos, insignias, symbols, or other lettering, designs, or artwork which identify a sports team, school, locality, group, society, membership, or any other entity which may be interested in or otherwise perceived to be served by displaying their identifying name, logo, insignia, symbol, or other lettering, designs, or artwork on a baseball cap. The selectively deployable material may also include names, logos, insignias, symbols, or other lettering, designs, or artwork which identify a sports team, school, locality, group, society, membership, or any other entity which may be interested in or otherwise perceived to be served by displaying their identifying name, logo, insignia, symbol, or other lettering, designs, or artwork on the section of material.

It is to be understood that the invention can be embodied in various forms, and is not to be limited to the examples discussed above. The range of components and configurations which can be utilized in the practice of the present invention is virtually unlimited.

The invention claimed is:

1. Headwear comprising:

a baseball cap portion comprising a crown portion and a bill;

said crown portion having a front side connected to said bill and a rear side opposite said bill;

said crown portion further comprising selectively deployable material extending from said rear side of said crown portion of said baseball cap;

said selectively deployable material including an elastic outer edge;

wherein said selectively deployable material has a first configuration and a second configuration;

said first configuration comprises said selectively deployable material tucked and concealed within said crown portion, providing the external appearance and feel to the wearer of a common baseball cap with no obvious modifications thereto;

said second configuration comprises said selectively deployable material deployed out from said crown portion and securely fitted around the wearer's head, ears, and neck;

wherein said elastic outer edge gathers said selectively deployable material toward said wearer's head, ears, and neck in said second configuration; and said selectively deployable material further comprising sewn-in tufts which further gather said selectively deployable material toward said wearer's head, ears, and neck in said second configuration.

2. Headwear according to claim 1, wherein:

said second configuration protects the wearer's head, ears, and neck from surrounding conditions.

3. Headwear according to claim 1, wherein:

said second configuration protects said wearer's head, ears, and neck from air movement, decreasing the loss of body heat from the wearer's head, ears, and neck by convection.

4. Headwear according to claim 1, wherein:

said second configuration decreases the loss of body heat from the wearer's head, ears, and neck from radiation.

5. Headwear according to claim 1, wherein:

said second configuration decreases the loss of body heat from the wearer's head, ears, and neck from conduction.

6. Headwear according to claim 1, wherein:

said second configuration decreases the loss of body heat from the wearer's head, ears, and neck from evaporation of sweat.

7. Headwear according to claim 1, wherein:

said first configuration provides an extra layer of protection from the loss of body heat through the top of the wearer's head.

8. Headwear according to claim 1, wherein:

said selectively deployable material comprises an inherently stretchable material selected from the list consisting of: polyester, polyester blend, spandex, and combinations thereof.

9. Headwear according to claim 1, wherein:

said elastic outer edge comprises an elasticized band.

10. Headwear according to claim 1, wherein:

said selectively deployable material further comprises a vertical opening; and said vertical opening accommodates the wearer's hair protruding through.

11. Headwear according to claim 10, wherein:

said vertical opening further comprises a vertical opening elastic edge to gather said wearer's hair protruding through.

12. Headwear according to claim 1, wherein said crown portion of said baseball cap comprises one fitted size.

13. Headwear according to claim 1, wherein said crown portion of said baseball cap comprises material with stretching properties allowing said headwear to fit multiple head sizes.

14. Headwear according to claim 1, wherein said crown portion of said baseball cap comprises an adjustable strap allowing said headwear to fit multiple head sizes.

15. Headwear for a wearer with elongated hair extensions extending from the back of the wearer's head, comprising:

a baseball cap portion comprising a crown portion and a bill;

said crown portion having a front side connected to said bill and a rear side opposite said bill;

said crown portion further comprising selectively deployable material extending from said rear side of said crown portion of said baseball cap;

said selectively deployable material including an elastic outer edge;

said elastic outer edge comprising an elasticized band;

wherein said selectively deployable material has a first configuration and a second configuration;

said first configuration comprises said selectively deployable material tucked and concealed within said crown portion, providing the external appearance and feel to the wearer of a common baseball cap with no obvious modifications thereto;

said second configuration comprises said selectively deployable material deployed out from said crown portion and securely fitted around the wearer's head, ears, and neck;

wherein said elastic outer edge gathers said selectively deployable material toward said wearer's head, ears, and neck in said second configuration;

said selectively deployable material further comprising sewn-in tufts which further gather said selectively deployable material toward said wearer's head, ears, and neck in said second configuration;

wherein said second configuration protects the wearer's head, ears, and neck from surrounding conditions and decreases the loss of body heat from the wearer's head, ears, and neck from convection, radiation, conduction, and evaporation of sweat;

wherein said first configuration provides an extra layer of protection from the loss of body heat through the top of the wearer's head;

wherein said selectively deployable material includes a vertical opening allowing the wearer's long hair extensions to protrude through; and wherein said vertical opening includes a vertical opening elastic edge to gather said wearer's hair protruding through.

16. Headwear comprising:

a baseball cap portion comprising a crown portion and a bill;

said crown portion having a front side connected to said bill, a rear side opposite said bill, and opposite right and left sides each between said front and rear sides;

said crown portion further comprising an adjustable strap on said rear side of said crown portion;

said adjustable strap having first and second sides and forming an opening on said rear side of said crown portion above said adjustable strap;

selectively deployable material stitched to said crown portion along an approximate inside, bottom circumference from an approximate midpoint of said left side of said crown portion towards the rear of said crown portion to an approximate position of said first side of said adjustable strap, along a portion of said crown portion above said opening on said rear side of said crown portion above said adjustable strap to an approximate position of said second side of said adjustable strap, and along said approximate inside, bottom circumference of said crown portion from said approximate position of said second side of said adjustable strap to an approximate midpoint of said right side of said crown portion;

said selectively deployable material including an elastic outer edge;

wherein said selectively deployable material has a first configuration and a second configuration;

said first configuration comprises said selectively deployable material tucked and concealed within said crown portion, providing the external appearance and feel to the wearer of a common baseball cap with no obvious modifications thereto;

wherein said opening on said rear side of said crown portion above said adjustable strap is open to the wearer's head in said first configuration;

said second configuration comprises said selectively deployable material deployed out from said crown portion and securely fitted around the wearer's head, ears, and neck;

wherein said elastic outer edge gathers said selectively deployable material toward said wearer's head, ears, and neck in said second configuration;

wherein said selectively deployable material lies underneath said adjustable strap in said second configuration and covers said opening on said rear side of said crown portion above said adjustable strap in said second configuration; and wherein said second configuration protects the wearer's head, ears, and neck from surrounding conditions.

* * * * *